US009187922B1

(12) United States Patent
Phillips, Jr.

(10) Patent No.: US 9,187,922 B1
(45) Date of Patent: Nov. 17, 2015

(54) FENCE ATTACHABLE AWNING

(71) Applicant: Robert Phillips, Jr., Hauppauge, NY (US)

(72) Inventor: Robert Phillips, Jr., Hauppauge, NY (US)

( * ) Notice: Subject to any disclaimer, the term of this patent is extended or adjusted under 35 U.S.C. 154(b) by 55 days.

(21) Appl. No.: 14/101,591

(22) Filed: Dec. 10, 2013

(51) Int. Cl.
*E04H 15/58* (2006.01)
*E04H 15/02* (2006.01)

(52) U.S. Cl.
CPC ..... *E04H 15/02* (2013.01); *E04H 15/58* (2013.01)

(58) Field of Classification Search
CPC ..... E04H 15/04; E04H 15/48; E04H 15/58; E04H 17/00; E04F 10/02; E04F 10/0633; E04F 10/00; F16B 45/02; F16B 9/023; F16B 45/06
USPC ..... 135/88.07, 88.16, 90, 117, 119, 147, 135/158, 161; 52/74–76, 83, 90.1, 94; 160/22, 24–26; 297/184.1, 184.15, 297/188.1; 256/23–27; 248/273, 215, 339, 248/340
See application file for complete search history.

(56) References Cited

U.S. PATENT DOCUMENTS 1,075,058 A * 10/1913 Orth ..... 454/220
1,731,113 A * 10/1929 Siegel ..... 248/273
1,750,271 A * 3/1930 Kasan ..... 160/58.1
2,105,409 A * 1/1938 Crawford ..... 160/63
2,618,285 A * 11/1952 Heisig ..... 135/90
3,032,046 A * 5/1962 Coonradt ..... 135/90
3,730,196 A * 5/1973 Borskey ..... 135/88.11
4,068,673 A 1/1978 Bernardi
4,719,954 A 1/1988 Curtis et al.
4,976,487 A * 12/1990 Ramos et al. ..... 296/152
6,050,280 A 4/2000 Jeske
6,145,677 A * 11/2000 Corniel ..... 211/105.1
6,796,359 B1 9/2004 Knutson
7,290,552 B1 11/2007 Eisbrenner
D664,264 S 7/2012 Cramer
8,458,964 B2 * 6/2013 Lamotte ..... 52/74
2004/0262589 A1 12/2004 Cotton
2007/0145213 A1 * 6/2007 Fischer ..... 248/205.1
2011/0047931 A1 * 3/2011 Wallgren ..... 52/745.19
2011/0303256 A1 * 12/2011 Ashley ..... 135/117

* cited by examiner

*Primary Examiner* — Winnie Yip
(74) *Attorney, Agent, or Firm* — Kyle A. Fletcher, Esq

(57) ABSTRACT

The fence attachable awning is constructed with a plurality of shade members that connect to form an awning. The plurality of shade members connects via a plurality of snap buttons to form the overall shape of the awning. The awning is attached to a set of frame supports that extend laterally from a respective hanging support. The awning attaches to the frame supports at a declination in order to enable rain to slope off of the awning when in use. The frame supports are constructed of individual components that collapse the frame support when not in use. The hanging supports of the frame supports are adapted to clip onto a top portion of a fence in order to support the frame support and awning there from.

10 Claims, 4 Drawing Sheets

FENCE ATTACHABLE AWNING

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of awnings and sunshades, more specifically, an awning that attaches to a fence.

SUMMARY OF THE INVENTION

An embodiment of the disclosure meets the needs presented above by generally comprising a plurality of shade members that connect to form an awning. The plurality of shade members connects via a plurality of snap buttons to form the overall shape of the awning. The awning is attached to a set of frame supports that extend laterally from a respective hanging support. The awning attaches to the frame supports at a declination in order to enable rain to slope off of the awning when in use. The frame supports are constructed of individual components that collapse the frame support when not in use. The a top portion of a fence in order to support the frame support and awning there from.

An object of the invention is to provide an awning structure that attaches itself to a top portion of a fence.

Another object of the invention is for the awning to be able to attach and detach itself with respect to the frame supports.

Another object of the invention is for the awning to be dissociated into individual shade members.

Another object of the invention is for the frame supports to collapse when not in use.

These together with additional objects, features and advantages of the fence attachable awning will be readily apparent to those of ordinary skill in the art upon reading the following detailed description of presently preferred, but nonetheless illustrative, embodiments of the fence attachable awning when taken in conjunction with the accompanying drawings.

In this respect, before explaining the current embodiments of the fence attachable awning in detail, it is to be understood that the fence attachable awning is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the fence attachable awning.

It is therefore important that the claims be regarded as including such equivalent construction insofar as they do not depart from the spirit and scope of the fence attachable awning. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
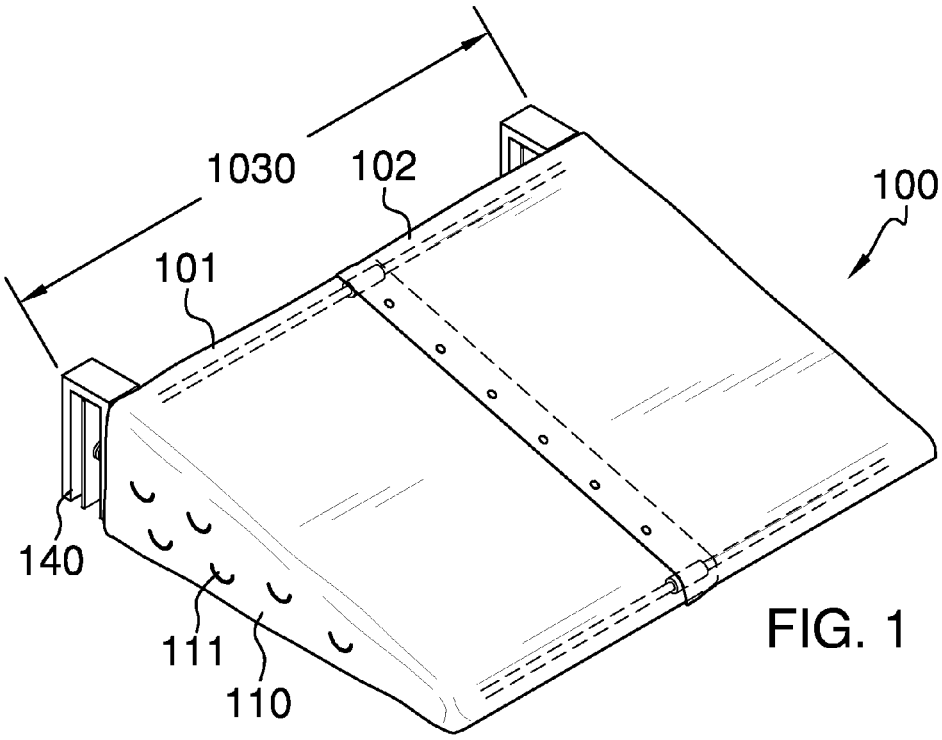
FIG. 1 is a perspective view of the fence attachable awning by itself.
Figure 2:
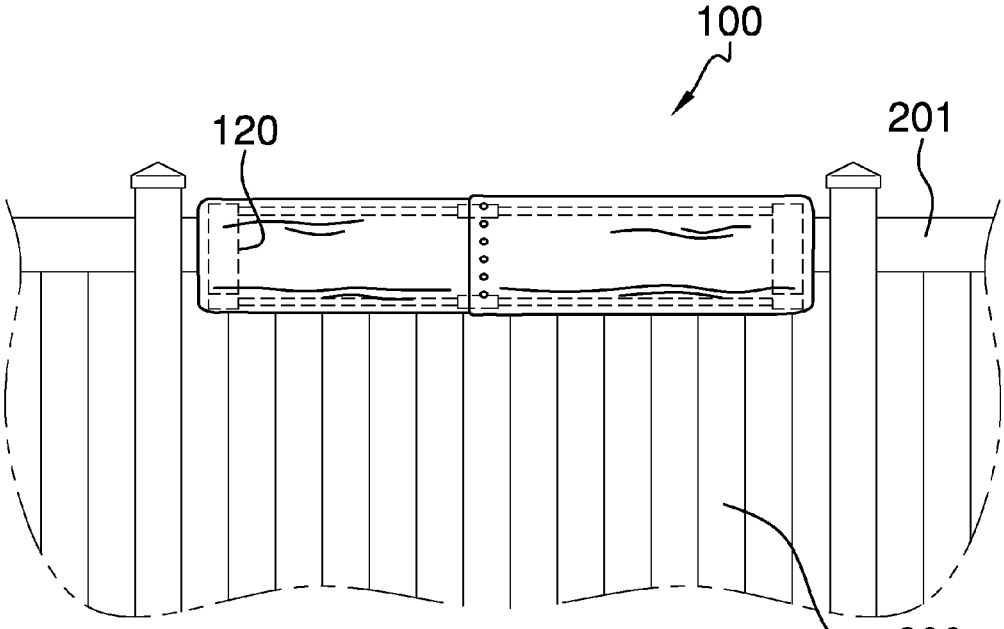
FIG. 2 is a view of the fence attachable awning attached to a top portion of a fence.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

As best illustrated in FIGS. 1 through 6, the fence attachable awning 100 (hereinafter invention) is further comprised of a first shade member 101 and a second shade member 102 that collectively form an awning 103. The first shade member 101 is further defined with a first, inner edge 104 that is adorned with a plurality of first fastening members 105. The second shade member 102 is further defined with a second, inner edge 106 that is adorned with a plurality of second fastening members 107. The first fastening members 105 connect with and correspond to the second fastening members 107 such that the first shade member 101 and the second shade member 102 attach together to form the awning 103. The first fastening members 105 and the second fastening members 107 may use snap buttons, hook and grommets, nylon hook and loop stripping, button and hole combinations. It shall be noted there may be a plurality of rows of first fastening members 105 (see FIG. 3) in order to adjust for an awning length 1030.

The first shade member 101 and the second shade member 102 are made of a fabric, which may be waterproof. The first shade member 101 and the second shade member 102 each have distal sides 110 that are triangular in shape, and which include slits 111 built therein to enable wind to pass there through. The awning 103 is able to connect with frame supports 120 at a declined angle 121.

The frame supports 120 are further defined with a first member 122, a second member 123, a third member 124, and a fourth member 125. The second member 123 is positioned in between the first member 122 and the third member 124. The third member 124 is positioned in between the second member 123 and the fourth member 125. The second member 123 and the third member 124 pivot with respect to one another via a pivoting hinge 130.

Figure 4:
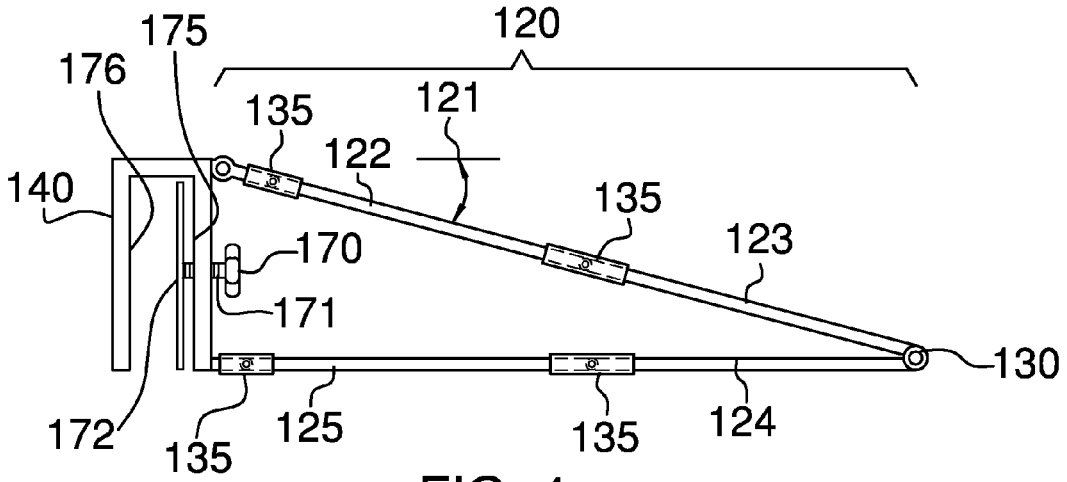
FIG. 4 is a side view of the support members and their respective hanging support.
Figure 5:
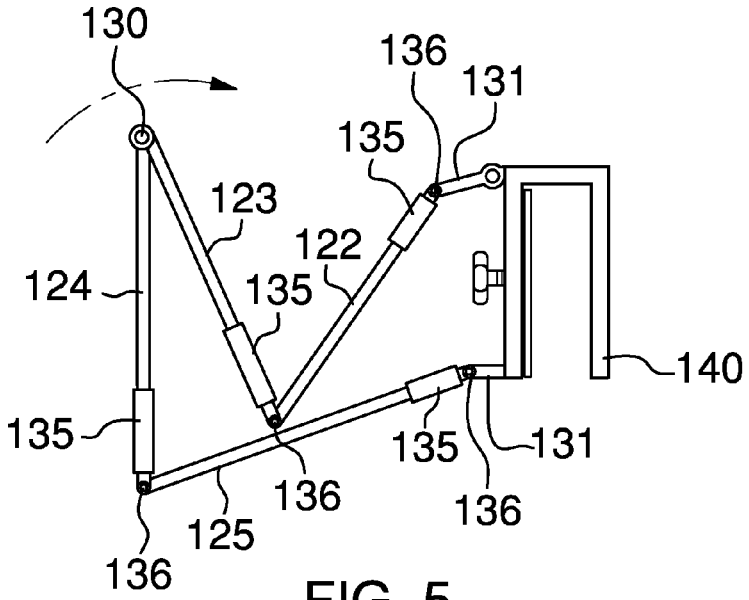
FIG. 5 is a view of the support members being collapsed.
Figure 6:
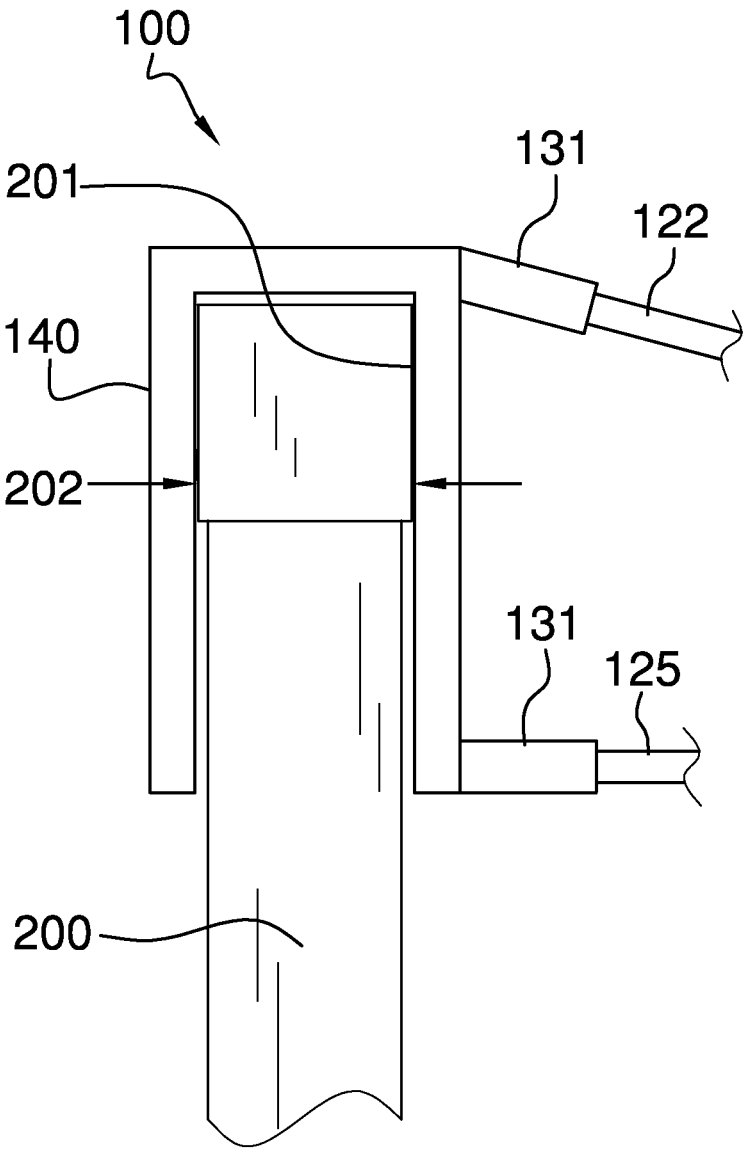
FIG. 6 is a detailed view of the hanging support seated atop of the top portion of the fence.

The invention 100 includes a series of locking members 135, which enable the frame supports 120 to be erected for an in-use scenario (see FIG. 4), and also enable the frame supports 120 to collapse when not in use (see FIG. 5). The first member 122 connects with the second member 123 via one of the locking members 135. The third member 124 and the fourth member 125 connect together via another one of the locking members 135.

The first member 122 and the fourth member 124 each attach to a linkage member 131 via one of the locking members 135. The linkage members 131 are affixed to a hanging support 140. The hanging supports 140 are each configured to secure and sit atop of a top portion 201 of a fence 200. The hanging supports 140 are further defined with an inverted "U" shaped body that slides down onto the top portion 201 of the fence 200 (see FIG. 6).

Referencing FIG. 5, the frame supports 120 each include a plurality of member pivot hinges 136. The member pivot hinges 136 enable adjacent members (first through fourth) to pivot in order for the frame supports 120 to collapse or erect for use. More specifically, the first member 122 as well as the fourth member 125 pivot with respect to the respective linkage member 131 via member pivot hinges 136. Moreover, the first member 122 connects with the second member 123 via one of the member pivot hinges 136. The third member 124 connects with the fourth member 125 via one of the member pivot hinges 136.

Figure 3:
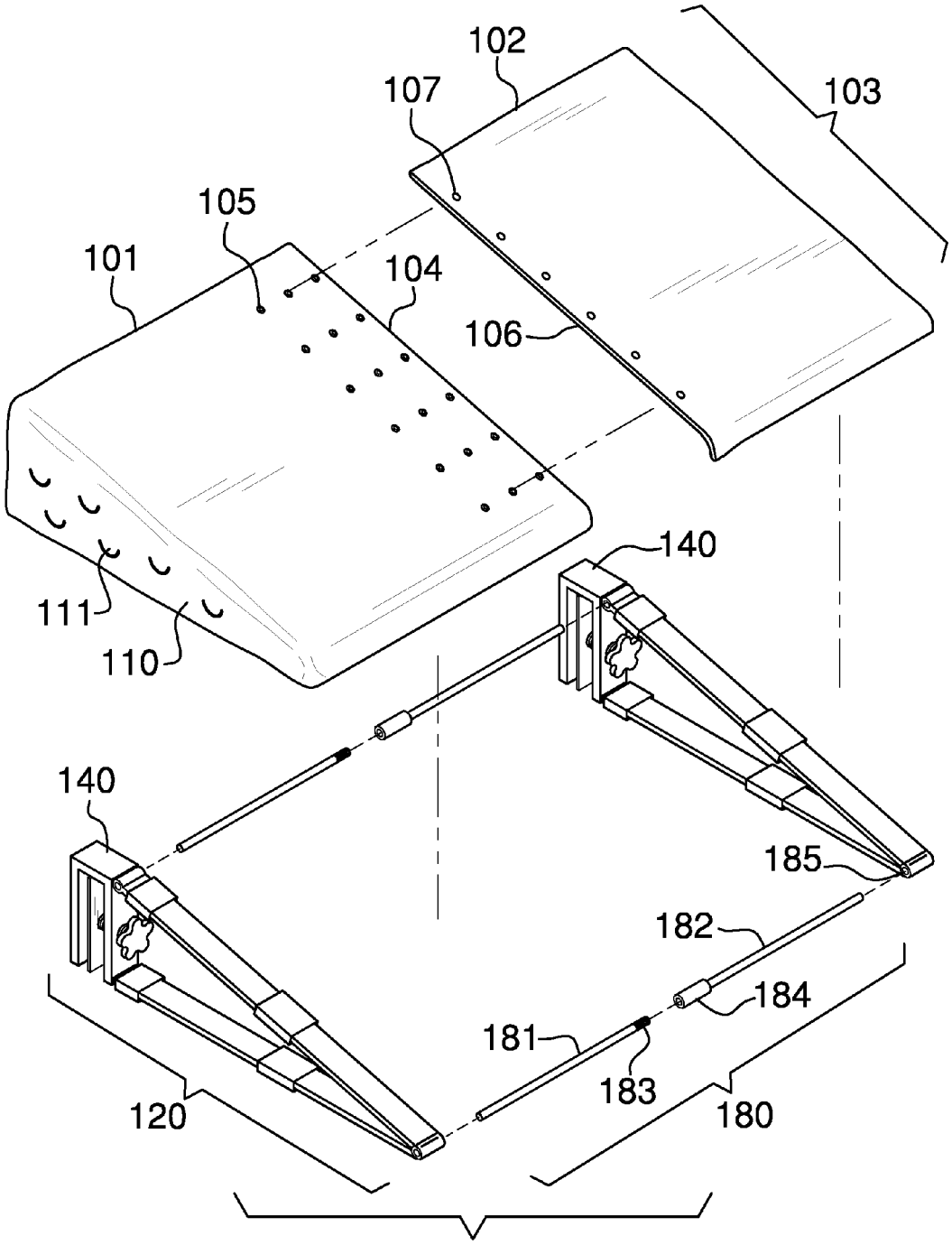
FIG. 3 is an exploded view of the shade members and the support members forming the fence attachable awning.

Referencing FIG. 3, the invention 100 may include a lateral support 180 that attaches to and extends between the frame supports 120. The lateral support 180 is constructed of a first lateral support 181 that connects with a second lateral support 182. The first lateral support 181 includes a threaded end 183 that screws onto a female threaded end 184 of the second lateral support 182. The lateral support 180 is inserted into lateral support holes 185 provided on each of the frame supports 120. The lateral support(s) 180 is(are) used to further support the awning 103 in order to prevent drooping.

Referencing FIGS. 3-4, the hanging supports 140 may include a knob 170 with a threaded bolt 171 that includes a plate 172. The plate 172 is positioned in between a first hanging support surface 175 and a second hanging support surface 176 of the hanging support 140. The plate 172 is able to move back and forth between the first hanging support surface 175 and the second hanging support surface 176 in order to accommodate different fence thicknesses 202.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A fence attachable awning comprising:

an awning that attaches to a set of frame supports;

said frame supports are affixed to hanging supports;

said hanging supports are configured to seat upon a top portion of a fence;

wherein said frame supports and said awning are adapted to extend outwardly with respect to said fence in order to provide shade under said awning;

wherein said awning is further comprised of a first shade member and a second shade member that connect to one another, and collectively form an overall shape of the awning;

wherein said first shade member is further defined with a first, inner edge that is adorned with a plurality of first fastening members; wherein said second shade member is further defined with a second, inner edge that is adorned with a plurality of second fastening members; wherein the first fastening members connect with and correspond to the second fastening members such that the first shade member and the second shade member attach together to form the awning;

wherein the first shade member and the second shade member are made of a fabric, which is waterproof; wherein the first shade member and the second shade member each has a distal side that is triangular in shape, and which includes slits built therein to enable wind to pass there through;

wherein the awning is able to connect with frame supports at a declined angle;

wherein the frame supports are further defined with a first member, a second member, a third member, and a fourth member; wherein the second member is positioned in between the first member and the third member; wherein the third member is positioned in between the second member and the fourth member; wherein the second member and the third member pivot with respect to one another via a pivoting hinge;

wherein a series of locking members enable the frame supports to be erected for an in-use scenario or to collapse; wherein the first member connects with the second member via one of the locking members; wherein the third member and the fourth member connect together via another one of the locking members;

wherein the first member and the fourth member each attach to a linkage member via one of the locking members; wherein the linkage members are affixed to the hanging supports respectively; wherein the locking members secure linear alignment of the first member to the second member as well as the third member to the fourth member as well as the first member to one of the linkage members as well as the fourth member to the other of the linkage members.

2. The fence attachable awning according to claim 1 wherein the first fastening members and the second fastening members are selected from a group consisting of snap buttons, hook and grommets, nylon hook and loop stripping, button and hole combinations.

3. The fence attachable awning according to claim 1 wherein the hanging supports are each configured to secure and sit atop of the top portion of the fence; wherein the hanging supports each is further defined with an inverted "U" shaped body that slides down onto the top portion of the fence.

4. The fence attachable awning according to claim 3 wherein the frame supports each include a plurality of member pivot hinges; wherein the member pivot hinges enable pivoting motion; wherein the first member as well as the fourth member pivot with respect to the respective linkage member via one of the member pivot hinges; wherein the first member connects with the second member via one of the member pivot hinges; wherein the third member connects with the fourth member via one of the member pivot hinges.

5. The fence attachable awning according to claim 4 wherein at least one lateral support attaches to and extends between the frame supports.

6. The fence attachable awning according to claim 5 wherein the lateral support is constructed of a first lateral support that connects with a second lateral support; wherein the first lateral support includes a threaded end that screws onto a female threaded end of the second lateral support; wherein the lateral support is inserted into lateral support holes provided on each of the frame supports; wherein the lateral support is used to further support the awning in order to prevent drooping.

7. The fence attachable awning according to claim 4 wherein the hanging supports each include a knob with a threaded bolt that includes a plate; wherein the plate is positioned in between a first hanging support surface and a second hanging support surface of the hanging support; wherein the plate is able to move back and forth between the first hanging support surface and the second hanging support surface in order to accommodate different fence thicknesses.

8. A fence attachable awning comprising:

an awning that attaches to a set of frame supports;

said frame supports are affixed to hanging supports;

said hanging supports are configured to seat upon a top portion of a fence;

wherein said frame supports and said awning are adapted to extend outwardly with respect to said fence in order to provide shade under said awning;

wherein said awning is further comprised of a first shade member and a second shade member that connect to one another, and collectively form an overall shape of the awning;

wherein said first shade member is further defined with a first, inner edge that is adorned with a plurality of first fastening members; wherein said second shade member is further defined with a second, inner edge that is adorned with a plurality of second fastening members; wherein the first fastening members connect with and correspond to the second fastening members such that the first shade member and the second shade member attach together to form the awning;

wherein the first fastening members and the second fastening members are selected from a group consisting of snap buttons, hook and grommets, nylon hook and loop stripping, button and hole combinations; wherein the first shade member and the second shade member are made of a fabric, which is waterproof; wherein the first shade member and the second shade member each has a distal side that is triangular in shape, and which include slits built therein to enable wind to pass there through;

wherein the awning is able to connect with frame supports at a declined angle; wherein the frame supports are further defined with a first member, a second member, a third member, and a fourth member; wherein the second member is positioned in between the first member and the third member; wherein the third member is positioned in between the second member and the fourth member; wherein the second member and the fourth member pivot with respect to one another via a pivoting hinge;

wherein a series of locking members enable the frame supports to be erected for an in-use scenario or to collapse; wherein the first member connects with the second member via one of the locking members; wherein the third member and the fourth member connect together via another one of the locking members; wherein the first member and the fourth member each attach to a linkage member via one of the locking members; wherein the linkage members are affixed to the hanging supports respectively; wherein the locking members secure linear alignment of the first member to the second member as well as the third member to the fourth member as well as the first member to one of the linkage members as well as the fourth member to the other of the linkage members.

9. The fence attachable awning according to claim 8 wherein the hanging supports are each configured to secure and sit atop of the top portion of the fence; wherein the hanging supports each is further defined with an inverted "U" shaped body that slides down onto the top portion of the fence; wherein the frame supports each include a plurality of member pivot hinges; wherein the member pivot hinges enable pivoting motion; wherein the first member as well as the fourth member pivot with respect to the respective linkage member via one of the member pivot hinges; wherein the first member connects with the second member via one of the member pivot hinges; wherein the third member connects with the fourth member via one of the member pivot hinges.

10. The fence attachable awning according to claim 9 wherein at least one lateral support attaches to and extends between the frame supports; wherein the lateral support is constructed of a first lateral support that connects with a second lateral support; wherein the first lateral support includes a threaded end that screws onto a female threaded end of the second lateral support; wherein the lateral support is inserted into lateral support holes provided on each of the frame supports; wherein the lateral support is used to further support the awning in order to prevent drooping; wherein the hanging supports each include a knob with a threaded bolt that includes a plate; wherein the plate is positioned in between a first hanging support surface and a second hanging support surface of the hanging support; wherein the plate is able to move back and forth between the first hanging support surface and the second hanging support surface in order to accommodate different fence thicknesses.

* * * * *